US010119348B2

(12) United States Patent
Kvinnesland

(10) Patent No.: US 10,119,348 B2
(45) Date of Patent: Nov. 6, 2018

(54) CORING TOOLS WITH IMPROVED RELIABILITY DURING CORE JAMS, AND RELATED METHODS

(71) Applicant: Baker Hughes Incorporated, Houston, TX (US)

(72) Inventor: Audun Kvinnesland, Tananger (NO)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 15/441,848

(22) Filed: Feb. 24, 2017

(65) Prior Publication Data

US 2017/0167214 A1 Jun. 15, 2017

Related U.S. Application Data

(63) Continuation of application No. 14/183,272, filed on Feb. 18, 2014, now Pat. No. 9,580,982.

(51) Int. Cl.
*E21B 25/00* (2006.01)
*E21B 10/02* (2006.01)

(52) U.S. Cl.
CPC ..... *E21B 25/00* (2013.01); *E21B 10/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,896,469 | A | 2/1933 | Soli | |
| 4,257,581 | A * | 3/1981 | Keeler, II | B60R 19/32 188/377 |
| 4,505,161 | A | 3/1985 | Hunt et al. | |
| 2014/0027182 | A1* | 1/2014 | Wilson | E21B 10/02 175/58 |
| 2015/0233201 | A1 | 8/2015 | Kvinnesland | |

FOREIGN PATENT DOCUMENTS

| | | | | |
|---|---|---|---|---|
| WO | WO-9428281 | A1 * | 12/1994 | E21B 25/00 |

* cited by examiner

*Primary Examiner* — D. Andrews
*Assistant Examiner* — Ronald R Runyan
(74) *Attorney, Agent, or Firm* — TraskBritt

(57) ABSTRACT

An inner barrel assembly for use with a coring tool may include a sleeve located coaxially within an inner barrel in a telescoping manner. The core barrel assembly may also include a cap located above a top end of the sleeve when the inner barrel assembly is in an initial coring position. The cap may include a skirt having a portion extending downwardly from the cap. A coring tool including an inner barrel assembly and methods of forming an inner barrel assembly are also disclosed.

20 Claims, 5 Drawing Sheets

CORING TOOLS WITH IMPROVED RELIABILITY DURING CORE JAMS, AND RELATED METHODS

CROSS-REFERENCE TO RELATED APPLICATION

This application is a continuation of U.S. patent application Ser. No. 14/183,272, filed Feb. 18, 2014, now U.S. Pat. No. 9,580,982, issued Feb. 28, 2017, the disclosure of which is incorporated herein in its entirety by this reference.

TECHNICAL FIELD

The present disclosure relates generally to apparatuses and methods for taking core samples of subterranean formations. More specifically, the present disclosure relates to an inner barrel assembly having telescoping features for absorbing multiple jams of core sample material against the telescoping features.

BACKGROUND

When seeking information regarding the characteristics of an earth formation, such as, for example, the degree to which it is saturated in hydrocarbons, a core sample may be obtained from the earth formation. The core sample may then be analyzed to determine the characteristics of the earth formation. Core samples may be obtained using coring tools. A coring tool may include an inner barrel assembly located with an outer barrel in a manner such that the outer barrel, having a core bit at a bottom thereof, may rotate about a longitudinal axis of the coring tool while an inner barrel, having an inner bore for receiving the core sample, remains substantially rotationally stationary within the outer barrel. The core bit may include an inner bore and a cutting structure surrounding the inner bore. In many instances, the outer barrel is assembled section by section into a pre-drilled wellbore, and thereafter the inner barrel assembly is assembled section by section within the outer barrel until the inner barrel assembly is fully assembled and located in a longitudinally fixed but rotationally free, fully operational "coring" position relative to the outer barrel.

As the coring tool is driven into an earth formation, the core bit may remove earth material around a core sample, which is received into the inner bore. The inner barrel may extend longitudinally above the inner bore of the core bit. The core sample may be received into the inner barrel, and may be retained in the inner barrel by a core catcher to keep the core sample within the inner barrel as the coring tool is withdrawn from the borehole. As the core sample extends into the inner barrel, the core sample may contact a portion of the inner barrel and cause a significant increase in friction between the core sample and the inner barrel or even completely lock the core sample to the inner barrel. Such occurrences are often referred to in the art as "jamming." When jamming occurs during a coring operation, the operation must be terminated and the drill string tripped out from the wellbore. Jams may be caused by a number of factors. For example, a condition known in the art as "formation fault slant" may cause a wedging jam between the core sample and the inner barrel. Additionally, jams may be caused by collapse of unconsolidated core material or expansion of clay or other materials inside the core sample. In some instances, jams occur undetected, resulting in the core sample failing to enter the inner barrel as the coring tool continues to engage uncut formation material. In such instances, the core sample may inadvertently be destroyed as the jammed portion of the inner barrel grinds or mills away the core sample as the coring tool progresses downward into the formation. The information obtained from core samples is valuable for understanding the subterranean formation properties and conditions. Thus, jams resulting in a shortened coring run and/or a destroyed core sample and/or a core sample shorter than the maximum retrievable length result in loss of information, time and money.

BRIEF SUMMARY

In some embodiments, the present disclosure includes an inner barrel assembly for use with a coring tool. The inner barrel assembly includes a sleeve located coaxially within an inner barrel in a telescoping manner. The inner barrel assembly includes a cap located above a top end of the sleeve when the inner barrel assembly is in an initial coring position. A skirt extends downwardly from the cap.

In additional embodiments, the present disclosure includes a coring tool having an outer barrel and a core bit attached to a bottom end of the outer barrel. The coring tool includes an inner barrel assembly located within the outer barrel. The inner barrel assembly includes an inner barrel and a sleeve located coaxially within the inner barrel. The sleeve is arranged within the inner barrel in a telescoping manner. The inner barrel assembly includes a cap located above a top end of the sleeve when the inner barrel assembly is in an initial coring position. The cap includes a skirt having a portion extending downwardly from the cap.

In additional embodiments, the present disclosure includes a method of forming an inner barrel assembly for use with a coring tool. The method includes disposing a first sleeve coaxially within an inner barrel and disposing a second sleeve coaxially within the first sleeve, wherein the first sleeve and the second sleeve are arranged within the inner barrel in a telescoping manner. The method includes providing a cap having a bottom end proximate a top end of the second sleeve when the inner barrel assembly is in an initial coring position. The cap includes a skirt having a portion extending downwardly from the cap. The method also includes disposing the cap on the top end of the second sleeve, wherein the portion of the skirt extends into an annulus between the inner barrel and the second sleeve, and the cap and the skirt are configured to surround at least one of a top portion of the core sample and a top end of the second sleeve to guide the at least one of the top portion of the core sample and the top end of the second sleeve during upward translation of the at least one of the top portion of the core sample and the top end of the second sleeve within the inner barrel.

BRIEF DESCRIPTION OF THE DRAWINGS

While the specification concludes with claims particularly pointing out and distinctly claiming what are regarded as embodiments of the present disclosure, various features and advantages of this disclosure may be more readily ascertained from the following description of example embodiments of the disclosure provided with reference to the accompanying drawings.

DETAILED DESCRIPTION

The illustrations presented herein are not actual views of any particular earth-boring tool, core bit, inner barrel or component of such a tool, bit or barrel, but are merely idealized representations which are employed to describe embodiments of the present disclosure.

As used herein, directional terms, such as "above," "below," "up," "down," "upward," "downward," "top," "bottom," "top-most" and "bottom-most," are to be interpreted from a reference point of the object so described as such object is located in a vertical wellbore, regardless of the actual orientation of the object so described. For example, the terms "above," "up," "upward," "top" and "top-most" are synonymous with the term "uphole," as such term is understood in the art of subterranean wellbore drilling. Similarly, the terms "below," "down," "downward," "bottom" and "bottom-most" are synonymous with the term "downhole," as such term is understood in the art of subterranean wellbore drilling.

Figure 1:
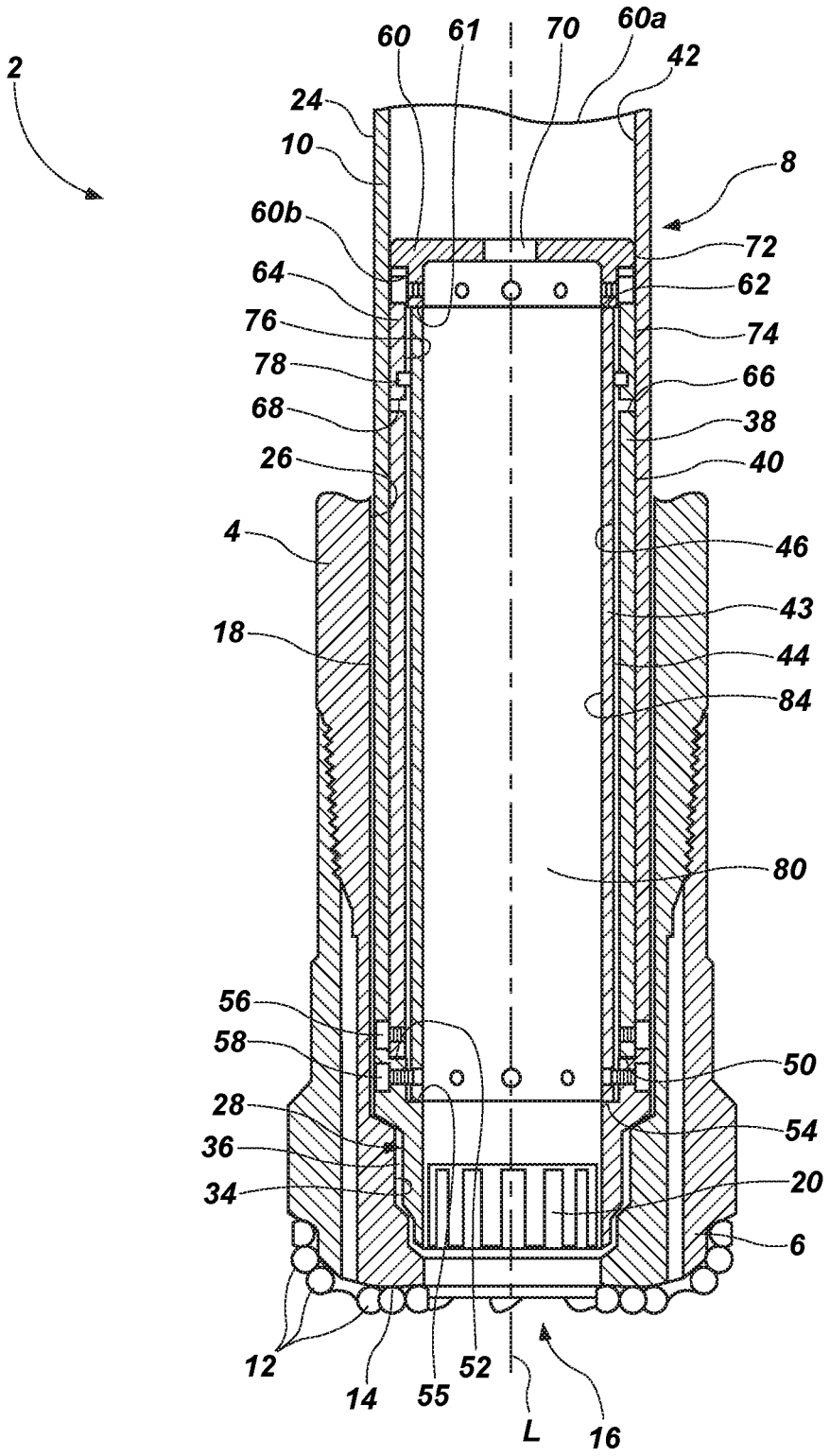
FIG. 1 illustrates a cross-sectional side view of a coring tool in an initial coring position, the coring tool having an inner barrel assembly disposed within an outer barrel, the outer barrel being attached to a core bit, according to an embodiment of the present disclosure.

FIG. 1 illustrates a coring tool 2 in an initial coring position. The coring tool 2 may include an outer barrel 4 having a core bit 6 attached at a bottom end of the outer barrel 4. An inner barrel assembly 8 may be located concentrically within the outer barrel 4 about a longitudinal axis L of the coring tool 2. The inner barrel assembly 8 includes an inner barrel 10 for receiving a core sample. During operation of the coring tool 2, to preserve the structural integrity and maximize the quality of the core sample, the inner barrel assembly 8 is prevented from rotating while the outer barrel 4 and the core bit 6 rotate about the inner barrel assembly 8. The core bit 6, having cutting elements 12 on a face 14 thereof, engages and removes formation material in an annular arrangement creating a central, substantially cylindrical, vertical column, or "core," of formation material. The outer barrel 4 may be connected to the remainder of the drill string and may transfer loads (e.g., weight-on-bit and torque) to the core bit 6 to drive the core bit 6 into the underlying formation material during the coring process. This core of formation material progressively extends through a central aperture 16 of the core bit 6 and into the inner barrel 10 as the core bit 6 cores formation material in a downward direction. Drilling fluid pumped down the drill string flows downward through an annular gap 18 between the inner barrel 10 and the outer barrel 4.

The coring tool 2 may include a core catcher 20 located proximate a lower end of the inner barrel assembly 8. The core catcher 20 may be of a collet design that is configured to allow the core sample to pass upwardly through collet fingers and into the inner barrel 10. The collet fingers may be configured and arranged to tighten around the core sample when the coring tool 2 is pulled upward away from the bottom of the wellbore to prevent the core sample from backing out of the coring tool 2 through the core catcher 20. Thus, with consolidated core samples, the core catcher 20 grips the core sample and generates tensile forces within the core sample below the collet that fracture the core sample when the coring tool 2 is pulled upward away from the bottom of the wellbore. However, in other embodiments, other types of core-catchers may be used, including wedged-collet core catchers, swinging gate core catchers, and any other type of core catcher, including those capable of catching unconsolidated core samples. It is to be appreciated that the embodiments of the present disclosure are not limited to include any particular core catcher or type of core catcher.

The inner barrel 10 may have an outer surface 24 located radially inward from an inner surface 26 of the outer barrel 4, such that the annular gap 18 is defined between the outer surface 24 of the inner barrel 10 and the inner surface 26 of the outer barrel 4. A bottom portion 28 of the outer surface 24 of the inner barrel 10 may have a contour matching a contour of an inner surface 34 of the core bit 6. The outer surface 24 of the inner barrel 10 and the inner surface 34 of the core bit 6 together define a narrow annular channel 36 through which drilling fluid may pass during operation of the coring tool 2.

The inner barrel assembly 8 may include a first sleeve 38 located concentrically within the inner barrel 10. The first sleeve 38 may be sized and configured to translate longitudinally upward in a telescoping manner relative to the inner barrel 10 responsive to a jam. For example, an outer surface 40 of the first sleeve 38 may have a diameter equivalent to or slightly less than a diameter of an inner surface 42 of the inner barrel 10. The inner barrel assembly 8 may also include a second sleeve 43 located concentrically within the first sleeve 38. The second sleeve 43 may be sized and configured to translate longitudinally upward in a telescoping manner relative to the first sleeve 38 and the inner barrel 10 responsive to a subsequent jam. For example, an outer surface 44 of the second sleeve 43 may have a diameter equivalent to or slightly less than a diameter of an inner surface 46 of the first sleeve 38. While FIG. 1 illustrates the inner barrel assembly 8 including two (2) telescoping sleeves 38, 43, in other embodiments, the inner barrel assembly 8 may include three (3), four (4), five (5), or more than five (5) telescoping sleeves. It is to be appreciated that the number of telescoping sleeves is not limited by the present disclosure.

With continued reference to FIG. 1, a bottom end 50 of the first sleeve 38 may abut a landing 52 of the inner surface 42 of the inner barrel 10 when the inner barrel assembly 8 is in the initial coring position. A bottom end 54 of the second sleeve 43 may extend longitudinally below the bottom end 50 of the first sleeve 38 and may abut against a second landing 55 of the inner surface 42 of the inner barrel 10 when the inner barrel assembly 8 is in the initial coring position. However, in additional embodiments, the bottom end 50 of the first sleeve 38 and the bottom end 54 of the second sleeve 43 may be located at substantially the same longitudinal location when the inner barrel assembly 8 is in the initial coring position. In yet further embodiments, the bottom end 50 of the first sleeve 38 may extend longitudinally below the bottom end 54 of the second sleeve 43 when the inner barrel assembly 8 is in the initial coring position. While FIG. 1 illustrates one possible embodiment of the first and second sleeves 38, 43, it is to be appreciated that the bottom ends 50, 54 of the first and second sleeves 38, 43 are not required to abut one or more landings of the inner surface 42 of the inner barrel 10.

As shown in FIG. 1, the second sleeve 43 may have a length greater than a length of the first sleeve 38 and may be positioned to completely cover the inner surface 46 of the first sleeve 38 when the inner barrel assembly 8 is in the initial coring position. In other embodiments, the length of the first sleeve 38 may be substantially equivalent to the length of the second sleeve 43. In such embodiments, by way of non-limiting example, the length of the first sleeve 38 and the second sleeve 43 may each be about 8 meters. In additional embodiments, the length of the second sleeve 43 may be less than the length of the first sleeve 38. In embodiments where the inner barrel assembly 8 includes more than two (2) telescoping sleeves (not shown), the innermost sleeve may have a length greater than a length of one or more or all of the other sleeves of the inner barrel assembly 8. In additional embodiments where the inner barrel assembly 8 includes more than two (2) telescoping sleeves, the length of each of the sleeves may be substantially equivalent; for example, the length of each of the sleeves may be about 8 meters.

The first sleeve 38 may be coupled to the inner barrel 10 by a first set of shear pins 56. The first set of shear pins 56 may be located proximate the bottom end 50 of the first sleeve 38, as shown. However, it is to be appreciated that the first set of shear pins 56 may be located at any longitudinal location of the inner barrel 10 and the first sleeve 38 when the inner barrel assembly 8 is in the initial coring position.

The second sleeve 43 may be coupled to the inner barrel 10 by a second set of shear pins 58. The second set of shear pins 58 may be located proximate the bottom end 54 of the second sleeve 43, as shown. However, it is to be appreciated that the second set of shear pins 58 may alternatively be located at any corresponding longitudinal location of the inner barrel 10 and the second sleeve 43 when the inner barrel assembly 8 is in the initial coring position. In other embodiments, the second set of shear pins 58 may couple the second sleeve 43 directly to the first sleeve 38, while only the first set of shear pins 56 is coupled to the inner barrel 10. While FIG. 1 illustrates that each of the first and second sets of shear pins 56, 58 include at least two (2) shear pins, in additional embodiments, the first sleeve 38 may be coupled to the inner barrel 10 by a single first shear pin, and the second sleeve 43 may be coupled to the inner barrel 10 by a single second shear pin. In yet additional embodiments, frangible elements other than shear pins may connect the first and second sleeves 38, 43 to the inner barrel 10, respectively. For example, in such yet additional embodiments, one or more of the first and second sleeves 38, 43 may be coupled to the inner barrel 10 by mechanical clamps or fasteners, friction elements, adhesives, welds or other bonding materials designed to fail at a predetermined upward force exerted on the respective first and second sleeve 38, 43 by a core sample. In further embodiments, one or more of the first and second sleeves 38, 43 may have a portion permanently coupled to the inner barrel 10 and may further include a frangible portion, such as a region having a reduced cross-section or circumferential apertures defining discrete tabs therebetween, located upward of the permanently coupled portion, wherein the frangible portion is designed to fail at a predetermined upward force exerted on the respective first or second sleeve 38, 43 by friction with a core sample. It is to be appreciated that the present disclosure encompasses any components, structure or method allowing the first and second sleeves 38, 43 to be dislodged from the initial coring position.

With continued reference to FIG. 1, the inner barrel assembly 8 may include a cap 60 located above the first and second sleeves 38, 43. When the inner barrel assembly 8 is in the initial coring position, gravity may cause a bottom end 61 of the cap 60 to rest upon a top end 62 of the second sleeve 43. The cap 60 may have a skirt 64 coupled thereto and extending downward from the cap 60 into an annular space defined between the inner barrel 10, the second sleeve 43, and a top end 66 of the first sleeve 38, such that a bottom end 68 of the skirt 64 is located proximate the top end 66 of the first sleeve 38 when the inner barrel assembly 8 is in the initial coring position. In other embodiments, the cap 60 and the skirt 64 may comprise integral portions of a unitary body, as described in more detail below.

The cap 60 may define a central aperture 70 extending therethrough to allow drilling fluid to pass through the cap 60 while the inner barrel assembly 8 is lowered into place during assembly of the inner barrel assembly 8 within the outer barrel 4. The cap 60 illustrated in FIG. 1 depicts a single, central aperture 70 extending therethrough; however, in additional embodiments, the cap 60 may include an eccentric aperture extending therethrough or a plurality of apertures extending through one or more of a top surface **60*a* and lateral surfaces 60*b* of the cap 60 to allow drilling fluid to pass therethrough during assembly. A radially outermost surface 72 of the cap 60 and an outer surface 74 of the skirt 64 may each have a diameter equivalent to or slightly less than a diameter of the inner surface 42 of the inner barrel 10, such that the cap 60 and the skirt 64 may translate together smoothly upward and downward relative to the inner barrel 10 during assembly of the inner barrel assembly 8 within the outer barrel 4 and during operation of the coring tool 2**, as described in further detail below.

As shown, the length of the skirt 64 may be less than a length of the first sleeve 38. However, in other embodiments, the length of the skirt 64 may be substantially equivalent to the length of the first sleeve 38. In yet other embodiments, the length of the skirt 64 may be greater than the length of the first sleeve 38. In some embodiments, a ratio of the length of the skirt 64 to the length of the first sleeve 38 may be in the range of about 1:72 to about 1:1. In yet other embodiments, the ratio of the length of the skirt 64 to the length of the first sleeve 38 may be in the range of about 1:1 to about 2:1. In yet additional embodiments, the ratio of the length of the skirt 64 to the length of the first sleeve 38 may be less than about 1:72. In further embodiments, the length of the skirt 64 may be at least equivalent to one-half (½) of the maximum diameter of a core sample within the inner barrel assembly 8. In yet further embodiments, the length of the skirt 64 may be less than one-half (½) of the maximum diameter of a core sample within the inner barrel assembly 8.

An inner surface 76 of the skirt 64 may include a recess for housing a friction element 78 engaging the inner surface 76 of the skirt 64 and the outer surface 44 of the second sleeve 43. The friction element 78 may include, by way of non-limiting example, a circumferential spring, an adhesive, a ring seal, or mating portions of the inner surface 76 of the skirt 64 and the outer surface 44 of the second sleeve 43, or any other friction element designed to cause a predetermined amount of friction between the skirt 64 and the second sleeve 43 sufficient to keep the skirt 64 joined with the second sleeve 43 until a predetermined upward force is exerted on the skirt 64 through the cap 60.

At the commencement of a coring run, the coring tool 2, including the inner barrel assembly 8 with the inner barrel 10, the first sleeve 38, the second sleeve 43, and the cap 60, may be positioned in the initial coring position, as shown in FIG. 1. In the initial coring position, the coring tool 2 is driven into an earth formation, and the core bit 6 may remove earth material around a core sample, which is received into the central aperture 16 of the core bit 6 and subsequently into a central bore 80 of the second sleeve 43. The components of the inner barrel assembly 8, including the first sleeve 38, the second sleeve 43, the cap 60 and the skirt 64, remain in the initial coring position relative to one another until the core sample causes movement of at least one component of the inner barrel assembly relative to at least one other component of the inner barrel assembly.

Figure 2:
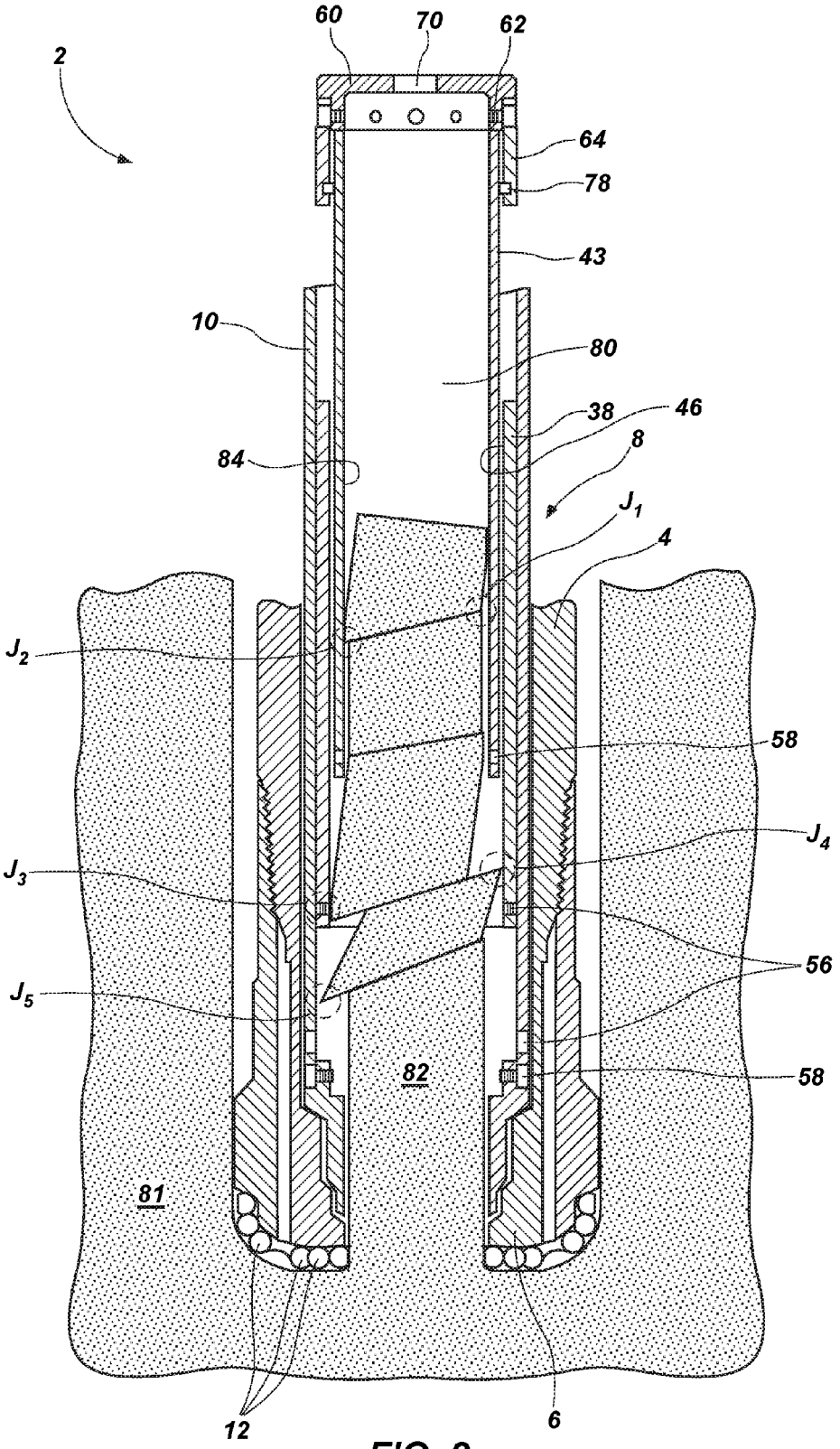
FIG. 2 illustrates a cross-sectional side view of the coring tool of FIG. 1 having a core sample extending therein and jamming components of the inner barrel assembly.

FIG. 2 illustrates the second sleeve 43 and the first sleeve 38 telescoping relative to the inner barrel 10 to overcome a series of jams in the inner barrel assembly 8. As the coring tool 2 is driven into formation material 81 and a core sample 82 extends into the central bore 80 of the second sleeve 43, the core sample 82 may jam against an inner surface 84 of the second sleeve 43 at locations $J_1$ and $J_2$. FIG. 2 illustrates jams caused by formation fault slant, although it is to be appreciated that the principles of operation of the inner barrel assembly 8 is the same regardless of whether jams are a result of formation fault slant, collapse of unconsolidated core material, clay expansion, or any other type of jam. If the jam at locations $J_1$ and $J_2$ exert enough friction against the inner surface 84 of the second sleeve 43 to impart the second sleeve 43 with an upward force in excess of the shear strength of the second set of shear pins 58, the second set of shear pins 58 will shear and the second sleeve 43 will translate with the core sample 82 upward in a telescoping manner relative to the first sleeve 38 and the inner barrel 10, while the first sleeve 38 remains coupled to the inner barrel 10 by the first set of shear pins 56. Such upward translation of the second sleeve 43 also translates the cap 60 and the skirt 64 upward with the second sleeve 43, wherein the cap 60 and the skirt 64 guide the second sleeve 43 with the core sample 82 therein smoothly upward through the inner barrel 10. As the second sleeve 43 translates upward in a telescoping manner relative to the first sleeve 38, the first sleeve 38 becomes exposed to the core sample 82.

It is to be appreciated that while components of the inner barrel assembly 8 are described as translating with the core sample 82 "upward" relative to the inner barrel 10 in a telescoping manner, such telescoping movement may also be described as the component remaining locked to the core sample 82 while the inner barrel 10 translates "downward" in a telescoping manner into the formation material 81.

A second jam of the core sample 82 at locations $J_3$ and $J_4$ longitudinally below the bottom end 54 of the second sleeve 43 may exert enough friction against the inner surface 46 of the first sleeve 38 to impart the first sleeve 38 with an upward force in excess of the shear strength of the first set of shear pins 56, causing the first set of shear pins 56 to shear and the first sleeve 38 to translate upward with the second sleeve 43 relative to the inner barrel 10. In the embodiment shown in FIG. 2, the first sleeve 38 is completely shielded from the core sample 82 by the second sleeve 43 when the inner barrel assembly 8 is in the initial coring position. However, in embodiments where the first sleeve 38 is not completely shielded from the core sample 82 by the second sleeve 43 when the inner barrel assembly 8 is in the initial coring position, the shear strength of the first set of shear pins 56 may be greater than a shear strength of the second set of shear pins 58 to ensure that the second sleeve 43 telescopes upward prior to the first sleeve 38 telescoping upward.

With continued reference to FIG. 2, a third jam of the core sample 82 at location $J_5$ longitudinally below the bottom end 50 of the first sleeve 38 may exert enough friction against the inner surface 42 of the inner barrel 10 to prevent the core sample 82, together with the first and second sleeves 38, 43 and the cap 60 and the skirt 64, from extending further upward into the inner barrel 10. At this juncture, an operator at the surface may terminate the coring operation, and retrieve the inner barrel assembly 8, with the core sample 82 therein, from the wellbore. In this manner, the coring tool 2 is capable of overcoming at least three (3) jams of the core sample 82, allowing the coring tool 2 to maximize the length of the core sample retrieved. In embodiments where the inner barrel assembly 8 includes more than two (2) telescoping sleeves, the inner barrel assembly 8 is capable of overcoming a number of jams at least equivalent to the total number of telescoping sleeves, wherein the coring tool 2 may be withdrawn from the wellbore at the next jam thereafter.

Figure 3:
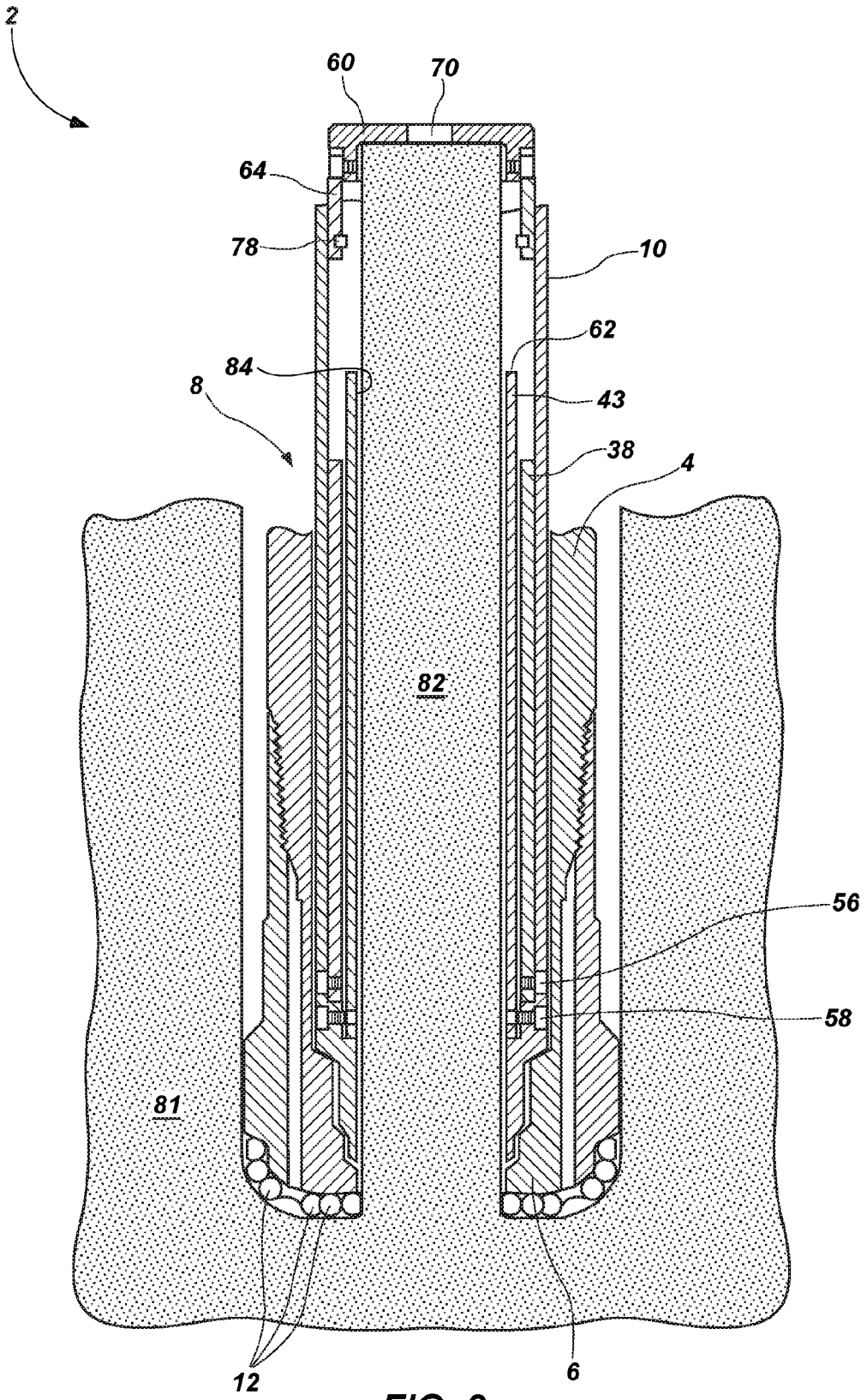
FIG. 3 illustrates a cross-sectional side view of the coring tool of FIG. 1 having a core sample extending therein, the core sample translating a cap of the inner barrel assembly upward.

Referring now to FIG. 3, as the coring tool 2 is driven into the formation, the core sample 82 extends into the central bore 80 of the second sleeve 43. So long as the core sample 82 does not contact the inner surface 84 of the second sleeve 43 with enough friction to impart an upward force on the second sleeve 43 in excess of the shear strength of the second set of shear pins 58 (i.e., jam within the second sleeve 43), the core sample 82 will extend upwardly into the central bore 80 of the second sleeve 43 until the core sample 82 abuts a bottom of the cap 60. As the coring tool 2 is driven further into the formation, the core sample 82 may lift the cap 60, with the skirt 64 connected thereto, off the top end 62 of the second sleeve 43 and relative to the inner barrel 10. The cap 60 and the skirt 64 may surround a top portion of the core sample 82 and guide the core sample 82 smoothly upward through the inner barrel 10. The core sample 82 may translate the cap 60 and the skirt 64 upward within the inner barrel 10 until a jam occurs or the core sample 82 reaches a maximum allowable length. Because the cap 60 is not permanently attached to the second sleeve 43, the second sleeve 43 remains coupled to the inner barrel 10 by the second set of shear pins 58 in the event that the core sample 82 reaches the cap 60 without jamming inside the second sleeve 43. Thus, in such a situation, the second sleeve 43 is still available to absorb a jam in the inner barrel assembly 8 even after the top of the core sample 82 has extended upward beyond the top end 62 of the second sleeve 43. If the cap 60 was permanently attached to the second sleeve 43, the second sleeve 43 would be forced to translate upward telescopically relative to the first sleeve 38 and the inner barrel 10 once the top of the core sample 82 reached the cap 60, removing the capability of the second sleeve 43 to absorb a jam within the inner barrel assembly 8.

In the embodiments shown in FIGS. 2 and 3, the inner barrel assembly 8 includes the first sleeve 38 and the second sleeve 43 located within the inner barrel 10 in a telescoping manner. However, it is to be appreciated that in other embodiments, the inner barrel assembly 8 may include additional telescoping sleeves that operate in a similar manner as disclosed in relation to the first and second sleeves 38, 43. In yet other embodiments, the inner barrel assembly 8 may include a single sleeve that translates upward in a telescoping manner relative to the inner barrel 10 in a similar manner as previously disclosed in relation to the first sleeve 38. It is to be appreciated that the coring tool 2 may be capable of absorbing at least a number of jams equivalent to the total number of telescoping sleeves. Subsequently, at the next jam, the coring tool 2 may be withdrawn from the borehole.

Figure 4:
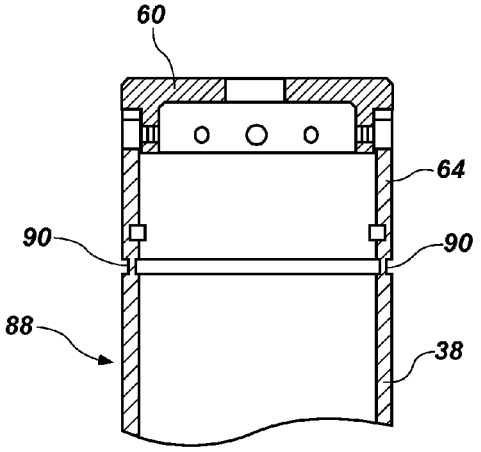
FIG. 4 illustrates a cross-sectional side view of a portion of a telescoping sleeve of the inner barrel assembly, the telescoping sleeve having two sleeve sections joined by a frangible portion, according to an embodiment of the present disclosure.

FIG. 4 illustrates another embodiment of the first sleeve 38 and the skirt 64. In this embodiment, the first sleeve 38 and the skirt 64 may comprise integral portions of a unitary tubular body 88 having a frangible portion 90 separating the first sleeve 38 and the skirt 64. The frangible portion 90 may be in the form of a circumferential section of the tubular body 88 having a reduced thickness relative to the first sleeve 38 and the skirt 64. The thickness of the frangible portion 90 may be designed to cause the frangible portion 90 to fail at a predetermined upward force exerted on the skirt 64 through the cap 60. For example, the skirt 64 and the first sleeve 38 may comprise integral portions of the unitary tubular body 88 to facilitate ease of assembly of the inner barrel assembly 8. Once the inner barrel assembly 8 is assembled, the frangible portion 90 may be configured to fracture upon a predetermined upward force transmitted to the skirt 64 through the cap 60 responsive to the core sample 82 extending to and pressing upward against the cap 60, with the skirt 64 connected thereto. In this manner, the skirt 64 may detach from the first sleeve 38, allowing the first sleeve 38 to remain coupled to the inner barrel 10 by the first set of shear pins 56 so that the first sleeve 38 may be available to absorb a jam. Thus, the tensile strength of the frangible portion 90 may be less than the shear strength of the first set of shear pins 56 so that the skirt 64 will detach from the first sleeve 38 prior to causing the first sleeve 38 to translate upward with the core sample 82 in the absence of a jam.

Figure 5:
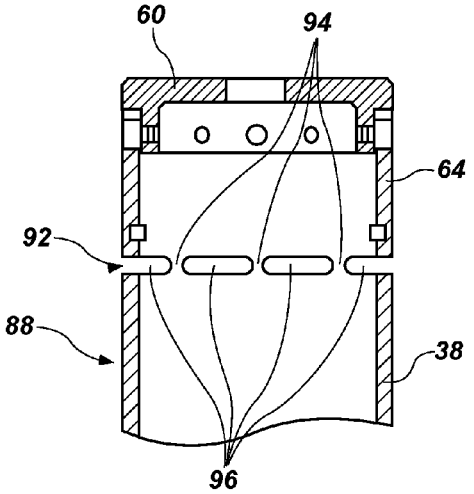
FIG. 5 illustrates a cross-sectional side view of a portion of a telescoping sleeve of the inner barrel assembly, the telescoping sleeve having two sections joined by a frangible portion, according to an additional embodiment of the present disclosure.

FIG. 5 illustrates a yet additional embodiment of the inner barrel assembly 8, wherein first sleeve 38 and the skirt 64 comprising integral portions of a unitary tubular body 88 having a frangible portion 92 separating the first sleeve 38 and the skirt 64. In this embodiment, the frangible portion 92 may comprise tabs 94 extending between pre-formed apertures 96 in a sidewall of the unitary tubular body 88 between the skirt 64 and the first sleeve 38. The number and size of the tabs 94 may be designed to impart the frangible portion 92 with a predetermined tensile strength to cause the frangible portion 92 to fail at a predetermined upward force exerted on the skirt 64 through the cap 60, as previously described. The tensile strength of the frangible portion 92 may be adjusted by adjusting the number, shape and circumferential width of the tabs 94.

Figure 6:
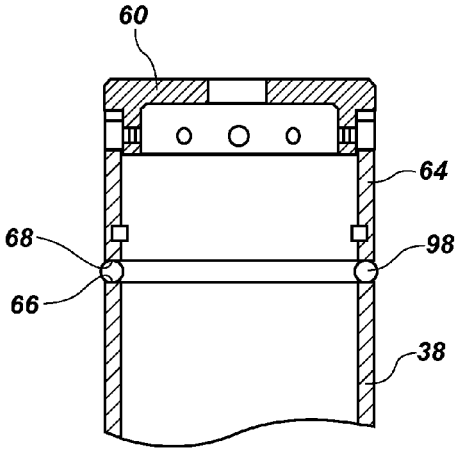
FIG. 6 illustrates a cross-sectional side view of a portion of a telescoping sleeve of the inner barrel assembly, the telescoping sleeve having two sleeve sections joined by a bonding element, according to an embodiment of the present disclosure.

FIG. 6 illustrates an additional embodiment of the first sleeve 38 and the skirt 64. In this embodiment, the first sleeve 38 and the skirt 64 are connected by a bonding material 98 bonding the bottom end 68 of the skirt 64 to the top end 66 of the first sleeve 38. The bonding material 98 may be in the form of an adhesive, a circumferential weld, or any other type of bonding material. The bonding material 98 may extend around the entire circumference of the bottom end 68 of the skirt 64 and the top end 66 of the first sleeve 38, or, alternatively, may extend around only one or more portions of the bottom end 68 of the skirt 64 and the top end 66 of the first sleeve 38. The bonding material 98 may be predetermined to fail at a predetermined upward force exerted on the skirt 64 through the cap 60. For example, the skirt 64 and the first sleeve 38 may be bonded together to facilitate ease of assembly of the inner barrel assembly 8. Once the inner barrel assembly 8 is assembled, the bonding material 98 may be configured to fail upon a predetermined upward force transmitted to the skirt 64 through the cap 60 responsive to the core sample 82 extending to and pressing the cap 60, with the skirt 64 connected thereto, upward. In this manner, the skirt 64 may separate from the first sleeve 38, allowing the first sleeve 38 to remain coupled to the inner barrel 10 by the first set of shear pins 56 so that the first sleeve 38 may be available to absorb a jam. Thus, the tensile strength of the bonding material 98 may be less than the shear strength of the first set of shear pins 56 so that the skirt 64 will detach from the first sleeve 38 prior to causing the first sleeve 38 to translate upward with the core sample 82 in the absence of a jam.

It is to be appreciated that, in further embodiments, the skirt 64 may be coupled to the first sleeve 38 by other elements that are designed to fail at a predetermined upward force exerted on the skirt 64 through the cap 60. By way of non-limiting example, the skirt 64 may be coupled to the first sleeve 38 by mechanical clamps or fasteners, adhesives, friction elements, or any other element configured to fail in a manner allowing the skirt 64 to separate from the first sleeve 38 at a predetermined upward force exerted on the skirt 64 through the cap 60.

Figure 7:
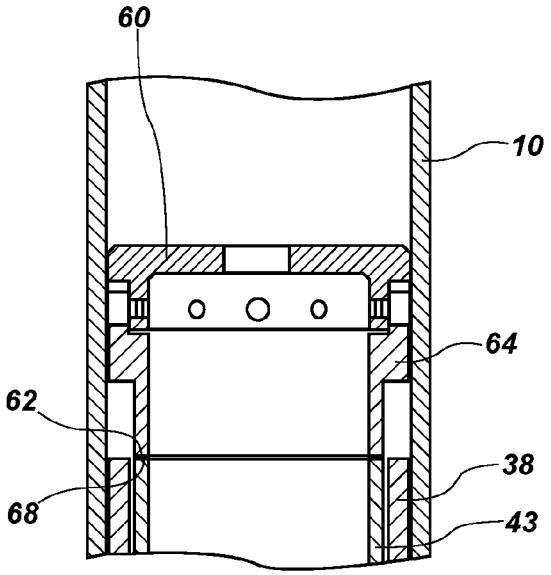
FIG. 7 illustrates a cross-sectional side view of a cap and skirt of the inner barrel assembly, according to an embodiment of the present disclosure.
Figure 8:
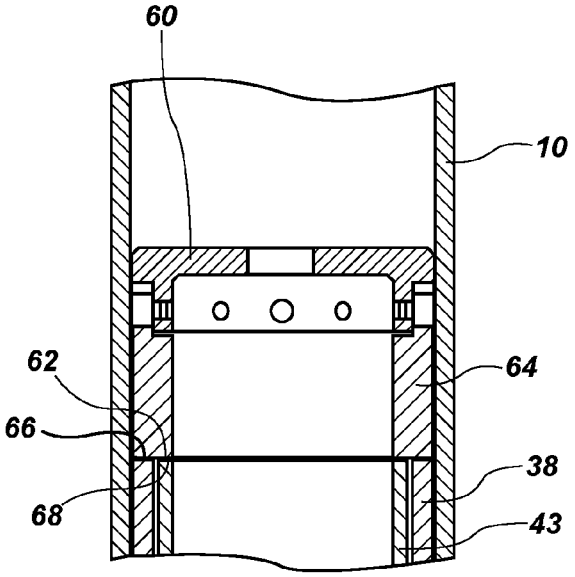
FIG. 8 illustrates a cross-sectional side view of a cap and skirt of the inner barrel assembly, according to an additional embodiment of the present disclosure.

Referring to FIG. 7, an additional embodiment of the coring tool 2 is shown in the initial coring position. In this embodiment, the bottom end 68 of the skirt 64 abuts the top end 62 of the second sleeve 43 when the inner barrel assembly 8 is in the initial coring position. In the embodiment of FIG. 8, the bottom end 68 of the skirt 64 abuts both the top end 66 of the first sleeve 38 and the top end 62 of the second sleeve 43 when the inner barrel assembly 8 is in the initial coring position. In further embodiments, the cap 60 and the skirt 64 may be located in the initial coring position as shown in FIG. 7 or FIG. 8, but may be coupled with one or more of the first and second sleeves 38, 43 in any of the manners previously described with reference to FIGS. 4-6. It is to be appreciated that the location of the cap 60 and the skirt 64 in relation to the telescoping sleeves of the inner barrel assembly 8 in the initial coring position is not limited by the present disclosure.

Although the foregoing description contains many specifics, these are not to be construed as limiting the scope of the present disclosure, but merely as providing certain example embodiments. Similarly, other embodiments of the disclosure may be devised which are within the scope of the present disclosure. For example, features described herein with reference to one embodiment may also be combined with features of other embodiments described herein. The scope of the disclosure is, therefore, indicated and limited only by the appended claims, rather than by the foregoing description. All additions, deletions, and modifications to the disclosure, as disclosed herein, which fall within the meaning and scope of the claims, are encompassed by the present disclosure.

What is claimed is:

1. An inner barrel assembly for use with a coring tool, comprising:

a plurality of sleeves located coaxially within an inner barrel, a first sleeve of the plurality being releasably attached to the inner barrel by a first releasable attachment, a second sleeve of the plurality being releasably attached to the first sleeve by a second releasable attachment, and located within the first sleeve;

a cap located above a top end of the plurality of sleeves when the inner barrel assembly is in an initial coring position; and a skirt extending downwardly from the cap to a third releasable attachment with at least one sleeve of the plurality of sleeves, wherein the inner barrel assembly is configured for operation in at least four distinct operational states:

a first operational state in which a core sample has not entered the coring tool, the first sleeve remains releasably attached to the inner barrel by the first releasable attachment, the second sleeve remains releasably attached to the first sleeve by the second releasable attachment, and the cap and skirt remain releasably attached to the at least one sleeve by the third releasable attachment;

a second operational state in which a core sample has advanced into the coring tool and has not jammed against the plurality of sleeves, the third releasable attachment is detached from the at least one sleeve, the cap and skirt are translated away from the at least one sleeve responsive to advancement of the core sample, the first sleeve remains releasably attached to the inner barrel by the first releasable attachment, and the second sleeve remains releasably attached to the first sleeve by the second releasable attachment;

a third operational state in which a core sample has advanced into the coring tool and has jammed against the plurality of sleeves once, the second releasable attachment is detached from the first sleeve, the second sleeve is translated away from its initial position responsive to advancement of the core sample, the first sleeve remains releasably attached to the inner barrel by the first releasable attachment, and the cap and skirt remain releasably attached to the at least one sleeve by the third releasable attachment, and a fourth operational state in which a core sample has advanced into the coring tool and has jammed against the plurality of sleeves at least twice, the first releasable attachment is detached from the inner barrel, the first sleeve is translated away from its initial position responsive to advancement of the core sample, the second releasable attachment is detached from the first sleeve, the second sleeve is translated away from its initial position responsive to advancement of the core sample, and the cap and skirt remain releasably attached to the at least one sleeve by the third releasable attachment.

2. The inner barrel assembly of claim 1, wherein the third releasable attachment is selected from the group consisting of a friction element located between the skirt and the at least one sleeve, a frangible portion located between the skirt and the at least one sleeve, and a bonding material located between the skirt and the at least one sleeve.

3. The inner barrel assembly of claim 2, wherein the third releasable attachment comprises the friction element, and wherein the friction element provides friction between the skirt and the at least one sleeve.

4. The inner barrel assembly of claim 2, wherein the third releasable attachment comprises the frangible portion and the frangible portion comprises an integral portion of a unitary tubular body having the skirt, the at least one sleeve, and the frangible portion, the frangible portion configured to fail at a predetermined upward force exerted on the skirt through the cap.

5. The inner barrel assembly of claim 2, wherein the third releasable attachment comprises the bonding material, the bonding material bonding a bottom end of the skirt to a top end of the at least one sleeve, the bonding material configured to fail at a predetermined upward force exerted on the skirt through the cap.

6. The inner barrel assembly of claim 1, wherein the inner barrel assembly is configured such that, so long as an amount of friction exerted by the core sample against the at least one sleeve is less than a threshold amount at which the second releasable attachment detaches from the first sleeve, a top of the core sample will abut against the cap and translate the cap and the skirt upward relative to the plurality of sleeves and the inner barrel.

7. The inner barrel assembly of claim 1, wherein the skirt extends downwardly from the cap into an annulus between the inner barrel and the second sleeve of the plurality of sleeves when the inner barrel assembly is in the first operational state, and a bottom end of the skirt is located proximate a top end of the first sleeve of the plurality of sleeves when the inner barrel assembly is in the first operational state.

8. The inner barrel assembly of claim 1, wherein the cap and the skirt are configured to surround at least a top portion of a core sample to guide the top portion of the core sample through the inner barrel during upward translation of the core sample within the inner barrel.

9. The inner barrel assembly of claim 1, wherein the skirt and cap are attached to the second sleeve of the plurality of sleeves when the inner barrel assembly is in the first operational state, the third operational state, and the fourth operational state.

10. The inner barrel assembly of claim 1, wherein the skirt and cap are attached to the first sleeve of the plurality of sleeves when the inner barrel assembly is in at least the first operational state.

11. A coring tool, comprising:

an outer barrel;

a core bit attached to a bottom end of the outer barrel; and an inner barrel assembly locatable within the outer barrel, the inner barrel assembly comprising:

an inner barrel;

a plurality of sleeves located coaxially within the inner barrel, a first sleeve of the plurality being releasably attached to the inner barrel by a first releasable attachment, a second sleeve of the plurality being releasably attached to the first sleeve by a second releasable attachment and located within the first sleeve;

a cap located above a top end of the plurality of sleeves when the inner barrel assembly is in an initial coring position; and a skirt extending downwardly from the cap to a third releasable attachment with at least one sleeve of the plurality of sleeves, wherein the inner barrel assembly is configured for operation in at least four distinct operational states:

a first operational state in which a core sample has not entered the coring tool, the first sleeve remains releasably attached to the inner barrel by the first releasable attachment, the second sleeve remains releasably attached to the first sleeve by the second releasable attachment, and the cap and skirt remain releasably attached to the at least one sleeve by the third releasable attachment;

a second operational state in which a core sample has advanced into the coring tool and has not jammed against the plurality of sleeves, the third releasable attachment is detached from the at least one sleeve, the cap and skirt are translated away from the at least one sleeve responsive to advancement of the core sample when the advancing core sample, the first sleeve remains releasably attached to the inner barrel by the first releasable attachment, and the second sleeve remains releasably attached to the first sleeve by the second releasable attachment;

a third operational state in which a core sample has advanced into the coring tool and has jammed against the plurality of sleeves once, the second releasable attachment is detached from the first sleeve, the second sleeve is translated away from its initial position responsive to advancement of the core sample, the first sleeve remains releasably attached to the inner barrel by the first releasable attachment, and the cap and skirt remain releasably attached to the at least one sleeve by the third releasable attachment, and a fourth operational state in which a core sample has advanced into the coring tool and has jammed against the plurality of sleeves at least twice, the first releasable attachment is detached from the inner barrel, the first sleeve is translated away from its initial position responsive to advancement of the core sample, the second releasable attachment is detached from the first sleeve, the second sleeve is translated away from its initial position responsive to advancement of the core sample, and the cap and skirt remain releasably attached to the at least one sleeve by the third releasable attachment.

12. The coring tool of claim 11, wherein the cap has a maximum diameter equivalent to or slightly less than an inner diameter of the inner barrel, and the cap and the skirt are configured to surround at least one of a top portion of the core sample and a top end of the at least one sleeve to guide the at least one of the top portion of the core sample and the top end of the sleeve during upward translation of the at least one of the top portion of the core sample and the top end of the sleeve within the inner barrel.

13. The coring tool of claim 11, wherein the third releasable attachment is selected from the group consisting of a friction element located between the skirt and a sleeve of the plurality of sleeves, a frangible portion located between the skirt and the sleeve of the plurality of sleeves, and a bonding material located between the skirt and the sleeve of the plurality of sleeves.

14. The coring tool of claim 13, wherein the third releasable attachment comprises the friction element, and wherein the friction element provides friction between the skirt and the at least one sleeve.

15. The coring tool of claim 13, wherein the third releasable attachment comprises the frangible portion and the frangible portion comprises an integral portion of a unitary tubular body having the skirt, the at least one sleeve, and the frangible portion, the frangible portion configured to fail at a predetermined upward force exerted on the skirt through the cap.

16. The coring tool of claim 13, wherein the third releasable attachment comprises the bonding material, the bonding material bonding a bottom end of the skirt to a top end of the at least one sleeve, the bonding material configured to fail at a predetermined upward force exerted on the skirt through the cap.

17. The coring tool of claim 11, wherein the inner barrel assembly is configured such that, so long as an amount of friction exerted by the core sample against the at least one sleeve is less than a threshold amount at which the second releasable attachment detaches from the first sleeve, a top of the core sample will abut against the cap and translate the cap and the skirt upward relative to the plurality of sleeves and the inner barrel.

18. The coring tool of claim 11, wherein the skirt and cap are attached to the second sleeve of the plurality of sleeves when the inner barrel assembly is in the first operational state.

19. The coring tool of claim 11, wherein the skirt and cap are attached to the first sleeve of the plurality of sleeves when the inner barrel assembly is in the first operational state.

20. A method of forming an inner barrel assembly for use with a coring tool, the method comprising:

placing a first sleeve coaxially within an inner barrel and releasably attaching the first sleeve to the inner barrel by a first releasable attachment;

placing a second sleeve coaxially within the first sleeve to form a plurality of sleeves and releasably attaching the second sleeve to the first sleeve by a second releasable attachment, wherein the first sleeve and the second sleeve are configured to move in a telescoping manner relative to the inner barrel;

providing a cap having a bottom end proximate a top end of at least one of the first sleeve and the second sleeve when the inner barrel assembly is in an initial coring position, the cap including a skirt having a portion extending downwardly from the cap; and detachably connecting the cap to the top end of the one of the first sleeve and the second sleeve utilizing a third releasable attachment, such that the inner barrel assembly is configured for operation in at least four distinct operational states:

a first operational state in which a core sample has not entered the coring tool, the first sleeve remains releasably attached to the inner barrel by the first releasable attachment, the second sleeve remains releasably attached to the first sleeve by the second releasable attachment, and the cap and skirt remain releasably attached to the at least one sleeve by the third releasable attachment;

a second operational state in which a core sample has advanced into the coring tool and has not jammed against the plurality of sleeves, the third releasable attachment is detached from the at least one sleeve, the cap and skirt are translated away from the at least one sleeve responsive to advancement of the core sample, the first sleeve remains releasably attached to the inner barrel by the first releasable attachment, and the second sleeve remains releasably attached to the first sleeve by the second releasable attachment;

a third operational state in which a core sample has advanced into the coring tool and has jammed against the plurality of sleeves once, the second releasable attachment is detached from the first sleeve, the second sleeve is translated away from its initial position responsive to advancement of the core sample, the first sleeve remains releasably attached to the inner barrel by the first releasable attachment, and the cap and skirt remain releasably attached to the at least one sleeve by the third releasable attachment; and a fourth operational state in which a core sample has advanced into the coring tool and has jammed against the plurality of sleeves at least twice, the first releasable attachment is detached from the inner barrel, the first sleeve is translated away from its initial position responsive to advancement of the core sample, the second releasable attachment is detached from the first sleeve, the second sleeve is translated away from its initial position responsive to advancement of the core sample, and the cap and skirt remain releasably attached to the at least one sleeve by the third releasable attachment.

* * * * *